US012687346B2

(12) United States Patent
Levin et al.

(10) Patent No.: US 12,687,346 B2
(45) Date of Patent: Jul. 21, 2026

(54) HEAT OR COLD STORAGE MULTILAYER RESERVOIR

(71) Applicants: Alexander Levin, Binyamina (IL); Hanan-Emanuel Levin, Binyamina (IL)

(72) Inventors: Alexander Levin, Binyamina (IL); Hanan-Emanuel Levin, Binyamina (IL)

( * ) Notice: Subject to any disclaimer, the term of this patent is extended or adjusted under 35 U.S.C. 154(b) by 185 days.

(21) Appl. No.: 18/297,019

(22) Filed: Apr. 7, 2023

(65) Prior Publication Data

US 2024/0337450 A1 Oct. 10, 2024

(51) Int. Cl.
*F28D 20/00* (2006.01)
*F28D 20/02* (2006.01)

(52) U.S. Cl.
CPC ..... *F28D 20/023* (2013.01)

(58) Field of Classification Search
CPC .... F28D 20/026; F28D 20/023; F28D 20/021; F28D 20/02; F28D 2020/0086; F28D 2020/0069; F28D 20/0056; F28D 2020/0021; F28D 2020/0017
See application file for complete search history.

(56) References Cited

U.S. PATENT DOCUMENTS 6,343,485 B1 * 2/2002 Duerr ..... F25D 3/005 62/434
11,519,675 B1 * 12/2022 Deivasigamani ... F28D 20/0039
2002/0000306 A1 * 1/2002 Bradley ..... F28D 20/021 165/902
2006/0225863 A1 * 10/2006 Levin ..... F28D 20/021 165/10
2012/0227926 A1 * 9/2012 Field ..... F24S 10/95 165/157
2014/0074314 A1 * 3/2014 Niknafs ..... G05D 23/19 700/300
2014/0305142 A1 * 10/2014 Aman ..... F28D 20/003 126/263.01
2016/0201995 A1 * 7/2016 Oliva Llena ..... F28F 21/04 165/10
2018/0347913 A1 * 12/2018 Mungas ..... F28D 20/023

* cited by examiner

*Primary Examiner* — Frantz F Jules
*Assistant Examiner* — Jason N Thompson

(57) ABSTRACT

A heat or cold storage reservoir is disclosed.
It comprises a thermos-insulated housing with multilayer heat or cold storage modules, wherein each module has a rigid structure shaped as a rectangular parallelepiped or a right cylinder and a set of sealed flexible packs containing phase change material (PCM).
Gaps between the sealed flexible packs and between the heat or cold storage modules and the internal walls of the thermos-insulated housing are filled up by pebble or coarse sand, or polymer foam particles.

2 Claims, 19 Drawing Sheets

HEAT OR COLD STORAGE MULTILAYER RESERVOIR

BACKGROUND OF THE INVENTION

This invention relates to the area of heat or cold management systems and, specifically, to the heat or cold management systems, which include application of phase change materials (PCM).

The main field of usage of these heat or cold management systems is thermal solar power plants that apply some types of optical concentrators of solar radiation in order to achieve sufficiently high temperature of heat transfer medium flowing in the receiver of a solar collector. However, the proposed heat management system can be used in other fields, for example, to decrease the energy consumption in thermal treatment of metals.

Another important application of the proposed heat or cold management system is cold accumulation in the form of ice in large air-conditioning systems during night-time.

It is known, that heat or cold can be stored in materials in the forms of sensible heat or latent heat. A material storing sensible heat can be in liquid form (for example, water, molten salts) and a bed of solid material (for example, concrete or ceramic packing, river rocks). The bed serves also as a heat exchanging structure.

Heat or cold storage in the latent form is performed usually by phase changes: solid-solid, solid-liquid or solid-liquid accompanied by chemical reactions (in the most cases, by reaction: dehydration-hydration).

This invention proposes a heat management reservoir with a packing, which can be related to solid-liquid phase change.

It should be noted, that phase-change storage allows to achieve high energy density with a resulting economical advantage. Design of a phase-change storage container must provide appropriate technical solutions to problems of poor heat transfer of a phase-change material (PCM), corrosion, possible chemical reaction between the PCM and a heat transfer fluid (HTF), possible change of the PCM volume in the process of the phase change.

Technology of micro- and macro-encapsulation is widely used in the modern practice in order to solve these problems.

However, this technology is very expensive and resulting specific cost of stored thermal energy is usually high.

There are some U.S. patents related to the area of heat or cold storage with application of PCM.

U.S. Pat. No. 4,086,958 describes heat exchange method and an apparatus, which are based on direct contact of two non-mixable media. Thermal contact of these media is performed by bubbling the liquid medium through the second medium, when the second medium is in the liquid phase.

U.S. Pat. No. 4,088,183 proposes a thermal energy storage housing that is designed like as a shell-and-tube heat exchanger.

U.S. Pat. No. 4,111,260 describes a thermal accumulator, which is designed as a closed vessel with a set of horizontal trays filled with PCM, wherein HTF flows across the outer surfaces of the PCM layers in the trays. This construction requires application of special means for holding the PCM in these trays.

U.S. Pat. No. 4,270,523 describes a heat storage apparatus with a plurality of heat exchanging elements mounted in a housing.

Each element has a central portion containing a storage medium, surrounded by portions through which a first and a second heat transfer fluids can be passed in heat contact with the storage medium.

U.S. patent application Ser. No. 20/020,000306 describes a device and method for storing thermal energy. The proposed device comprises: a) a container having inlet and outlet ports and at least one wall; b) at least one cell, this cell having two lateral sides and being placed within the aforementioned container such that the lateral sides of the cell are separated from the wall of the container; and c) at least one phase change material being capable of undergoing a phase change at a functional temperature above melting point of water at one atmosphere or pressure, this phase change material being disposed within the aforementioned cell.

In addition, U.S. Pat. Nos. 4,371,029, 4,807,696 and 6,116,330 should be noted. However, these patents do not provide a construction of a heat or cold storage, which is based on usage of ceramics or glass containers for their filling with PCM.

U.S. Pat. No. 7,222,569 to one author of the present invention (Alexander Levin) describes "the heat or cold storage reservoir, which is based on application of multi-channel blocks from ceramics, glass, glass ceramics or sulfur concrete; the parallel internal vertical channels of the blocks are open and sealed at their bottoms alternatively, and the channels with the sealed bottoms are filled partially with PCM".

However, it is a serious disadvantage of this patent that immediate contact between PCM and HTF is not prevented.

The article of Peter R. Payne "WHICH MATERIAL USES THE LEAST ENERGY?" (CHEMTECH, September 1980, pp. 550/557) demonstrates importance of application of ceramics in construction of solar collectors as a low-energy-cost material. Conclusions of this article are true for the case of construction of heat or cold storage plants.

EP U.S. Pat. No. 17,173,081 to inventors of Axiotherm company describes a macro-encapsulated PCM module shaped as an oblate disk.

U.S. patent application Ser. No. 17/586,822 filed at Jan. 28, 2022 by Hanan Levin and Alexander Levin describes a heat or cold storage multilayer tank with PCM, which includes arrangement of the PCM in the form of relatively thin layers situated in flat flexible containers (packs), which are sealed and arranged in narrow compartments (ducts) of rigid blocks, wherein these narrow compartments alternate with narrow throughout ducts.

The rigid blocks are fabricated from ceramics, glass, glass ceramics, polymer fibro reinforced concrete or glass-fiber reinforced concrete and they are provided with sets of parallel internal vertical narrow ducts; these internal narrow ducts are open and closed alternatively at their bottoms, and the narrow ducts with the sealed bottoms are provided with flexible sealed packs filled with PCM (the thickness of the PCM layers conforms the width of the narrow ducts). The filled flexible packs can be sealed by welding, brazing, soldering or folding.

BRIEF SUMMARY OF THE INVENTION

This invention proposes in general an improved design of a heat or cold storage reservoir with multilayer heat or cold modules.

A thermo-insulated housing of the heat or cold storage reservoir is provided with two opposite inlet and outlet connections, which intended for supply and withdrawal heat transfer fluid (HTF) in/out the internal space of this thermo-insulated reservoir; HTF can be in liquid or gaseous forms. In such a way, there is one direction of HTF flow in the internal space of the thermo-insulated reservoir.

This internal space is provided with multilayers of heat or cold storage modules, wherein each this heat or cold module comprises a rigid structure from metal or ceramics; these rigid structures are permeable for HTF flow.

The rigid structures have preferably a rectangular parallelepiped or a right cylindrical shape.

The internal space, which is limited by planes or cylindrical surfaces determined by elements of the rigid structure, is provided with a set or sets of sealed flexible packs having an oblate shape and filled partially with phase change material (PCM) that changes its state from solid to liquid and vice versa at a certain temperature.

These sealed flexible packs are arranged in the internal space of the rigid structure in parallel with gaps between the neighboring sealed flexible packs.

These gaps are permeable for HTF flow for installation of rigid structure in multilayer arrangement in the internal space of the thermo-insulated reservoir.

The gaps between the oblate sealed flexible packs are filled with pebble or coarse sand.

In addition, the gaps between the heat or cold storage structures and the gaps between the rigid structures and the internal walls of the thermo-insulated reservoir are filled with pebble or coarse sand too.

This invention proposes three methods for required installation of the sealed flexible packs in the rigid structures.

In the first method, the rigid structure designed as a rectangular parallelepiped is provided with a perforated bottom plate or some bottom strips and two opposite sides of this rectangular parallelepiped rigid structure serve for installation of two opposite sets of vertical guiding members, which are protruded inside. the widths of these guiding members conform the widths of the sealed flexible packs, and their pace conforms the required gaps between neighboring sealed flexible packs. The sealed flexible packs in an oblate shape, when PCM contained in them is in solid state, are introduced with their vertical edges into the vertical guiding member and they are supported from below by the perforated bottom plate or some bottom strips.

Thereafter the gaps between the sealed flexible packs in their oblate shapes are filled with pebble or coarse sand.

The second method is based on three elements:

1. The upper edges of the rigid structure designed as a rectangular parallelepiped are provided with two opposite sets of recesses. In the case of the rigid structure of a cylindrical shape a flange of this cylindrical rigid structure serves for installation of some parallel metal profiles provided with recesses. Analogically, the upper edges of the rigid structure designed as a rectangular parallelepiped can serve for installation of two opposite metal profiles with recesses.

2. The upper edges of the sealed flexible packs are joined with crossbars, wherein the extreme sections of these crossbars are protruded regarding the contours of the sealed flexible packs.

3. The extreme sections of the crossbars are placed in the upper recesses of the rigid structure.

The inner free space of the rigid structure is filled with pebble or coarse sand.

In such a way, it allows to construct a heat or cold storage module.

In the third method the rigid structure shaped as a rectangular parallelepiped is provided with two opposite metal strips, which are situated near the internal lateral sides of this rigid structure and formed in a periodic way; each period comprises: a sub-section serving as a supporting element for extreme sections of the lower part of the oblate sealed flexible pack filled partially with PCM; intermediate sub-section, which determines a gap between two neighboring oblate sealed flexible packs; two extreme sections being engaged with two other opposite lateral sides of the rigid structure.

The free internal space of the rigid structure is filled with pebble or coarse sand.\

It should be noted that the multilayer arrangement of the heat or cold storage modules in the thermo-insulated reservoir, which was described above, is provided with at least one grid dividing the internal space of this reservoir on two sub-sections: one—between the inlet connection of the reservoir and the multilayer arrangement of the heat or cold storage modules and the other—the space, which is occupied with these modules.

The grid prevents introduction of pebble or coarse sand into the first space,

On the other hand, the free internal space of the thermo-insulated reservoir, which is related to each layer of the heat or cold storage modules, is filled with pebble or coarse sand.

There are some examples of rigid structures and modules with sealed flexible packs and a thermo-insulated reservoir with a multilayer arrangement of such heat or cold storage modules.

In a first example, there is a ceramic housing comprising four vertical walls and a perforated bottom, The inner surfaces of two opposite walls of the ceramic housing are provided with pairs of vertical ribs serving as guiding elements for vertical edges of the oblate flexible packs. The distance between the neighboring pairs of the ribs determines gaps between the neighboring sealed flexible packs. The gaps between the flexible packs are filled in with pebble or coarse sand with a proper range of sizes of their particles; in such a way, this pebble or coarse sand fillings restrict the buckling phenomenon of the flexible packs under hydrostatic pressure of PCM.

In addition, the gaps between the walls of the ceramic housing and the sealed flexible packs, or the gaps between the pairs of the neighboring flexible packs serve for passage of heat transfer fluid (HTF) that supplies or releases latent heat of melting or solidification of PCM contained in the sealed flexible packs and sensible heat of pebble filling.

The ceramic housing may be fabricated from common ceramics, fire clay, glass, glass ceramics, fibro reinforced concrete or glass-fiber reinforced concrete.

The flexible packs, which are fabricated from metal foil, can be sealed by welding, brazing, soldering or folding. The flexible packs, which are fabricated from polymer or laminated metal foil, can be sealed by welding.

It should be noted that PCM fills in only a portion of the internal space of each flexible pack. In a preferable case, the internal void space in the sealed flexible pack is under sub-atmospheric pressure.

The height of the flexible packs is shorter than the vertical height of the ceramic housing.

PCM can contain a filler for improving thermal conductivity or another filler comprising a nucleating agent, or a combination thereof.

A second example demonstrates application of the second method of arrangement of the sealed flexible packs in the internal space of a rigid structure.

In this second example the rigid structure is realised as a ceramic housing shaped as a rectangular parallelepiped with four vertical walls. In this case two opposite upper edges of the ceramic rectangular housing are provided with sets of recesses, Each sealed flexible pack with PCM is joined at is upper edge with a crossbar, wherein the outside sections of this crossbar are protruded somewhat from the contour of the sealed flexible pack. It gives possibility to hang the sealed flexible pack in the ceramic housing by positioning of outside sections of the crossbars in the opposite recesses.

In the third example, which demonstrates the first method of arrangement of the sealed flexible packs in the internal space of a rigid structure, the sealed flexible packs with PCM are arranged in the internal space of a metal carcass shaped as a rectangular parallelepiped, which is fabricated from angles. The metal carcass is joined with a perforated bottom plate or some bottom strips, and there are two sets of vertical U-profiles, which are installed on two opposite internal sides of the metal carcass.

These U-profiles serve as guiding elements for installation of the sealed flexible packs, wherein PCM contained in these sealed flexible packs is in its solid state.

The fourth example demonstrates again the second method of arrangement of the sealed flexible packs in the internal space of a rigid structure.

There is a rectangular parallelepiped metal carcass with two additional angles installed on two opposite upper angles of the rectangular parallelepiped metal carcass, wherein these additional angles are provided with two opposite sets of recesses serving for placing of outside sections of crossbars joined with upper edges of sealed flexible packs with PCM.

In fifth example, which demonstrates the second method, a metal carcass is designed as two horizontal metal hoops joined by some struts, wherein the lower hoop serves as a basis and the upper one—for installation of a set of parallel horizontal crossbars from U-profiles, wherein each U-profile at its vertical shelves is provided with recesses serving for positioning outside sections of the crossbars of the sealed flexible packs with PCM described previously.

The outer diameter of the metal hoops conforms the internal diameter of a thermo-insulated reservoir for heat or cold storage, wherein this reservoir is designed as a cylindrical vertical vessel.

It should be noted that all gaps between the sealed flexible packs with PCM in its solid state and between these sealed flexible packs and the internal walls of the reservoir for heat or cold storage are filled with pebble or coarse sand of properly size in the process of structuring the layers of the described modules in the internal space of the thermo-insulated reservoir.

The sixth example of this invention demonstrates a third method of arrangement of the sealed flexible packs with PCM in the internal space of a rigid structure: a ceramic housing, a metal housing or a metal carcass having a perpendicular shape is provided with two metal strips, which are placed inside near its two opposite walls. Each metal strips forms a periodic longitudinal structure with three types of its sub-sections: the sub-sections, which serve for placing of two extreme sections of the sealed flexible packs with PCM, wherein this PCM is in its solid state; intermediate sub-sections, which determine gaps between two neighbouring oblate sealed flexible packs; two extreme sub-sections of each metal strip, which serve for engagement with two other opposite sides of the rigid structure.

After installation of each layer of such heat or cold storage modules with PCM, free space of this layer in the thermo-insulated reservoir is filled by pebble or coarse sand.

It should be noted, that in the case of application of the sealed flexible packs with sufficiently low temperature of PCM's melting—solidification, it is possible to apply foamed plastic particles of proper size as spacing members between the sealed flexible packs, and between PCM modules and the internal walls of the reservoir for heat or cold storage.

The thermo-insulated housing of the heat or cold storage multilayer reservoir can be provided with a distributor of HTF, which is mounted in the upper section of the heat or cold storage multilayer reservoir.

The abovementioned heat or cold storage modules are situated in the heat or cold storage multilayer reservoir in the form of one or more layers supported by supporting grids, which, in turn, are positioned on supporting rings.

The external walls of the heat or cold storage reservoir are provided with a layer of thermal insulation.

This heat or cold storage reservoir can be designed as a cylindrical vessel with vertical axis or as a reservoir shaped as a rectangular parallelepiped.

The heat or cold storage multistage reservoir can be filled up with different PCM heat or cold storage modules with gradually increasing (or decreasing) melting points from one stage of these heat or cold storage modules to their another stage.

DETAILED DESCRIPTION OF THE INVENTION

Figure 1A:
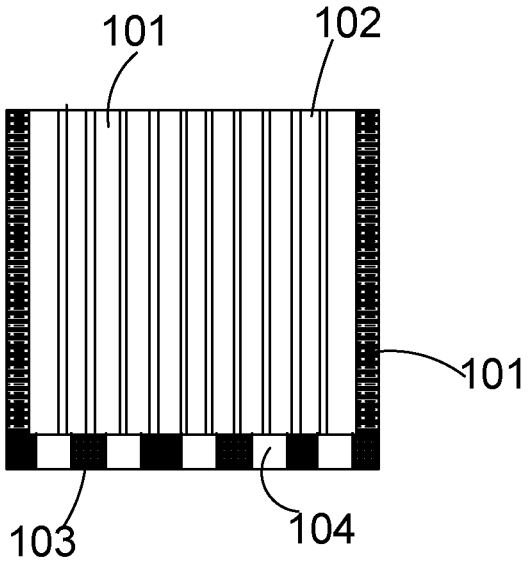
FIG. 1*a* and FIG. 1*b* are a vertical cross-section and a view from above of a ceramic rectangular casing of a heat or cold storage module with vertical internal ribs on two opposite walls of the ceramic rectangular casing serving as guiding elements for sealed flexible packs containing PCM, and a ceramic perforated plate joined with the bottom edges of the ceramic rectangular casing.
Figure 1B:
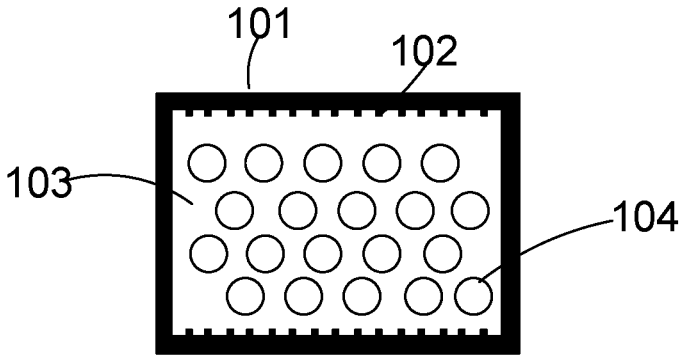

FIG. 1*a* and FIG. 1*b* are a vertical cross-section and a view from above of a ceramic rectangular casing with vertical internal ribs on two opposite walls of the ceramic rectangular casing serving as guiding elements for sealed flexible packs containing PCM, and a ceramic perforated plate joined with the bottom edges of the ceramic rectangular casing.

These drawings comprise: the vertical walls 101 of the ceramic rectangular casing with the vertical ribs 102 on the internal sides of two opposite walls 101, the perforated bottom plate 103 with perforations 104.

Figure 1C:
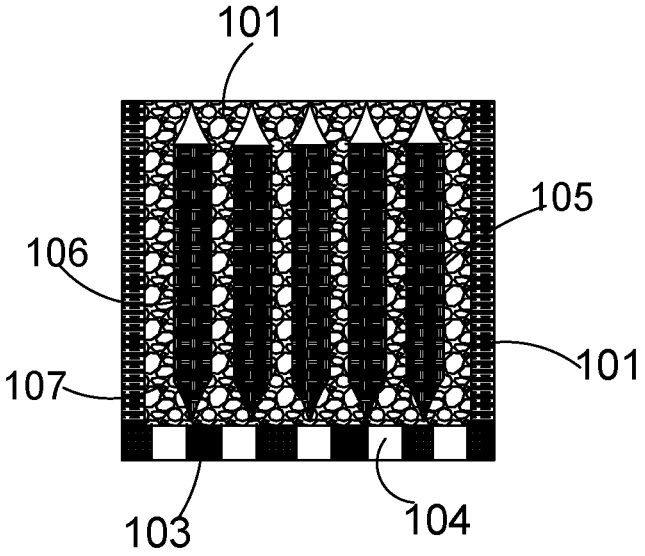
FIG. 1*c* is a vertical cross-section of the ceramic rectangular casing with the set of the vertical internal ribs on two opposite walls of the ceramic rectangular casing and sealed flexible packs containing PCM, and the ceramic perforated plate joined with the bottom edges of the ceramic rectangular casing.

FIG. 1*c* is a vertical cross-section of the ceramic rectangular casing with the set of the vertical internal ribs on two opposite walls of the ceramic rectangular casing and sealed flexible packs containing PCM, and the ceramic perforated plate joined with the bottom edges of the ceramic rectangular casing.

This drawing comprises: the vertical walls 101 of the ceramic rectangular casing, the perforated bottom plate 103 with perforations 104; the sealed flexible packs 105 containing PCM 106 and pebble filling 107, which controls buckling phenomena of the sealed flexible packs 105 with melted PCM 106 under hydraulic pressure.

Figure 2A:
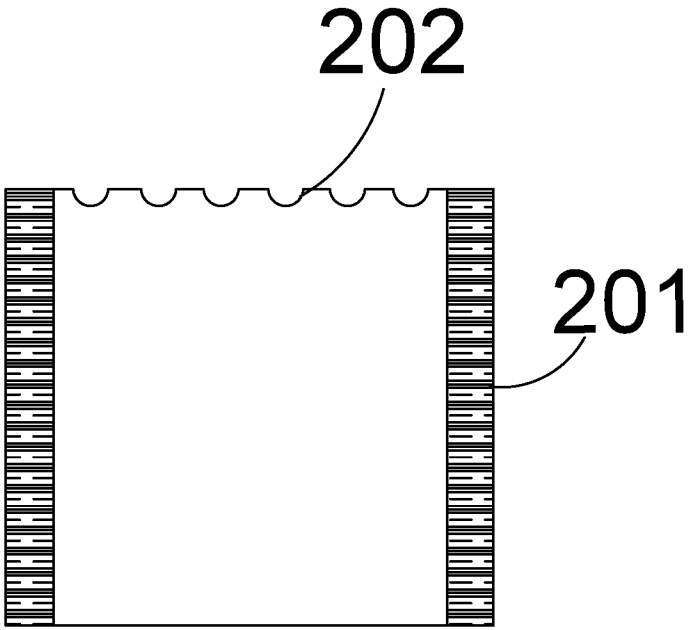
FIG. 2*a* and FIG. 2*b* are a vertical cross-section and a view from above of a ceramic rectangular casing, which comprises four vertical walls; the upper edges of two opposite vertical walls are provided with sets of recesses.
Figure 2B:
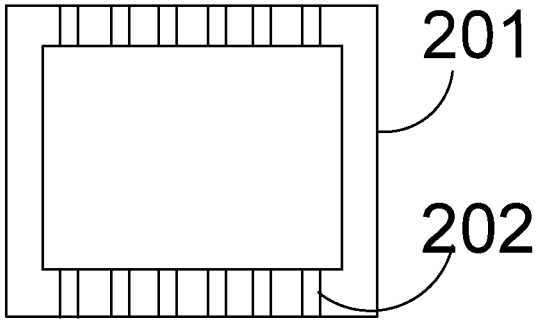

FIG. 2*a* and FIG. 2*b* are a vertical cross-section and a view from above of a ceramic rectangular casing, which comprises four vertical walls; the upper edges of two opposite vertical walls are provided with sets of recesses.

These drawings comprise: the vertical walls 201 of the ceramic rectangular casing with sets of recesses 202 on the upper edges of two opposite walls 201.

Figure 2C:
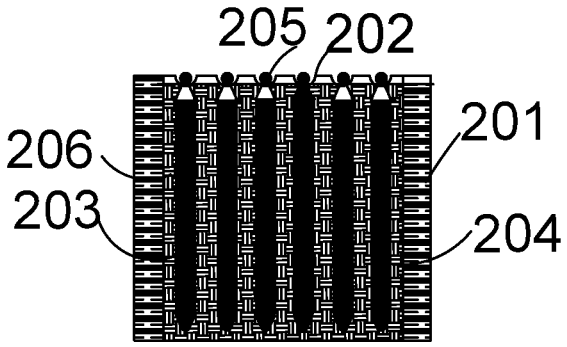
FIG. 2*c* is the vertical cross-section of the ceramic rectangular casing, which comprises four vertical walls; the upper edges of two opposite vertical walls are provided with the sets of the recesses, and there are sealed flexible packs containing PCM; the upper edges of these sealed flexible packs are joined with crossbars with outside sections, which are protruded outwards regarding the contours of the sealed flexible packs and these outside sections are arranged in the recesses of the ceramic rectangular casing.

FIG. 2*c* is the vertical cross-section of the ceramic rectangular casing, which comprises four vertical walls; the upper edges of two opposite vertical walls are provided with the sets of the recesses, and there are sealed flexible packs containing PCM; the upper edges of these sealed flexible packs are joined with crossbars with outside sections, which are protruded outwards regarding the contours of the sealed flexible packs and these outside sections are arranged in the recesses of the ceramic rectangular casing.

This drawing shows: the vertical walls 201 of the ceramic rectangular casing with sets of recesses 202 on the upper edges of two opposite walls 201; sealed flexible packs 203 with PCM 204; these sealed flexible packs are joined with crossbars 205; a pebble filling 206, which control buckling phenomena of the sealed flexible packs 203 with melted PCM 204 under hydraulic pressure.

Figure 3A:
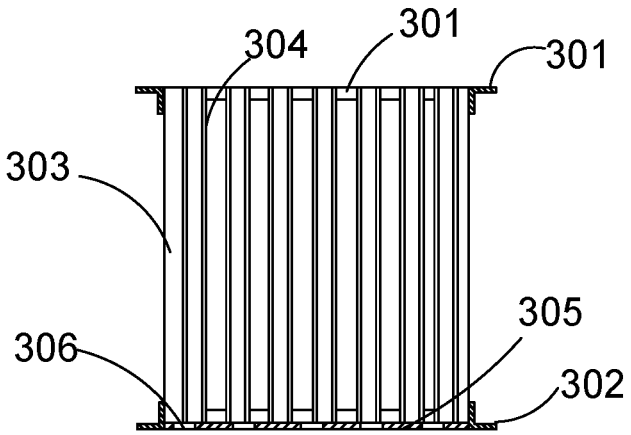
FIG. 3*a* is a view from above of a metal carcass shaped as a rectangular parallelepiped with a perforated metal plate installed at its bottom and two sets of vertical metal U-profiles installed on its opposite sides.

FIG. 3*a* is a view from above of a metal carcass shaped as a rectangular parallelepiped with a perforated metal plate installed at its bottom and two sets of vertical metal U-profiles installed on its opposite sides.

This drawing shows upper angles 301, lower angles 302; vertical angles 303 the vertical U-profiles 304 installed the opposite sides of the metal carcass, a perforated plate 305 with perforations 306; this perforated plate 305 is installed on the lower angles 302.

Figure 3B:
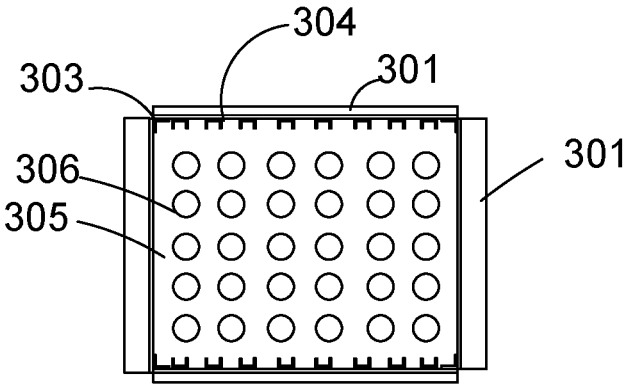
FIG. 3*b* is a vertical cross-section of the metal carcass shaped as the rectangular parallelepiped with the perforated metal plate installed at its bottom and two sets of the vertical metal U-profiles installed on its opposite sides.

FIG. 3*b* is a vertical cross-section of the metal carcass shaped as the rectangular parallelepiped with the perforated metal plate installed at its bottom and two sets of the vertical metal U-profiles installed on its opposite sides.

This drawing shows upper angles 301, lower angles 302; vertical angles 303; the vertical U-profiles 304 installed the opposite sides of the metal carcass, a perforated plate 305 with perforations 306; this perforated plate 305 is installed on the lower angles 302.

Figure 3C:
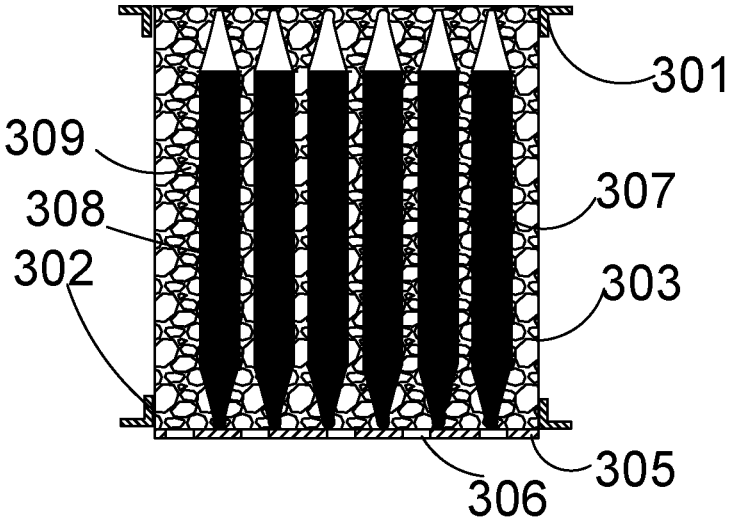
FIG. 3*c* is the vertical cross-section of the metal carcass shaped as the rectangular parallelepiped with the perforated metal plate installed at its bottom and two sets of the vertical metal U-profiles installed on its opposite sides and sealed flexible packs containing PCM, which are installed in the internal space of this metal carcass.

FIG. 3*c* is the vertical cross-section of the metal carcass shaped as the rectangular parallelepiped with the perforated metal plate installed at its bottom and two sets of the vertical metal U-profiles installed on its opposite sides and sealed flexible packs containing PCM, which are installed in the internal space of this metal carcass.

This drawing shows: the upper angles 301, the lower angles 302; the vertical angles 303; the perforated plate 305 with perforations 306; this perforated plate 305 is installed on the lower angles 302; sealed flexible packs 307 with PCM 308; the pebble filling 309, which restricts buckling phenomena of the sealed flexible packs 307 with melted PCM 308 under hydraulic pressure.

Figure 4A:
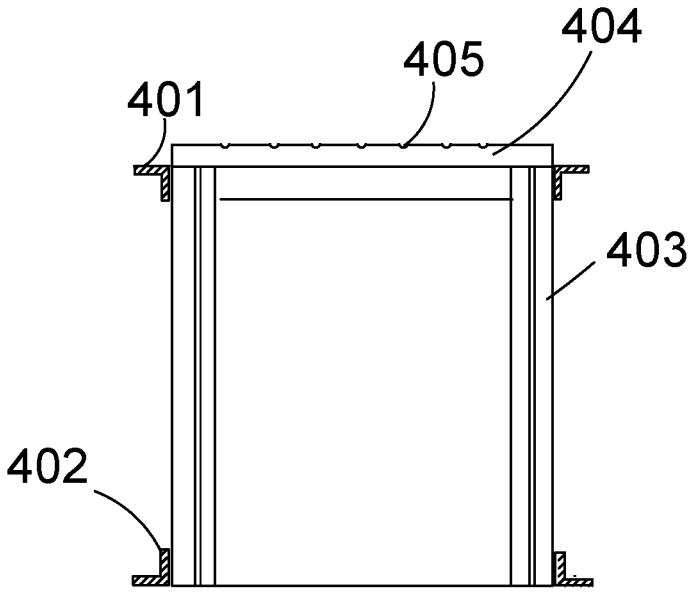
FIG. 4*a* is a view from above of a metal carcass shaped as a rectangular parallelepiped with two auxiliary angles installed on two opposite upper edges of the metal carcass; the vertical shelves of these angles are provided with sets of recesses.

FIG. 4*a* is a view from above of a metal carcass shaped as a rectangular parallelepiped with two auxiliary angles installed on two opposite upper edges of the metal carcass; the vertical shelves of these angles are provided with sets of recesses.

This drawing shows upper angles 401, lower angles 402; vertical angles 403; two auxiliary angles 404 with recesses 405; these auxiliary angles 404 are installed on two opposite upper edges of the metal carcass.

Figure 4B:
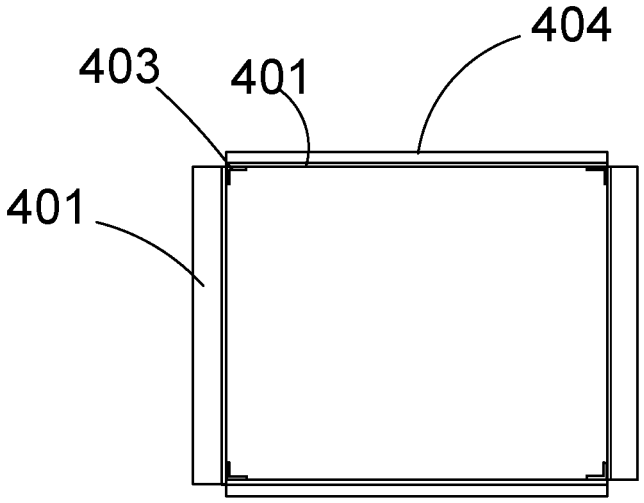
FIG. 4*b* is a cross-section of the metal carcass shaped as the rectangular parallelepiped with two auxiliary angles installed on two opposite upper edges of the metal carcass; the vertical shelves of these angles are provided with sets of recesses.

FIG. 4*b* is a cross-section of the metal carcass shaped as the rectangular parallelepiped with two auxiliary angles installed on two opposite upper edges of the metal carcass; the vertical shelves of these angles are provided with sets of recesses.

This drawing shows the upper angles 401, the lower angles 402; the vertical angles 403; two auxiliary angles 404 with recesses 405; these auxiliary angles 404 are installed on two opposite upper edges of the metal carcass.

Figure 4C:
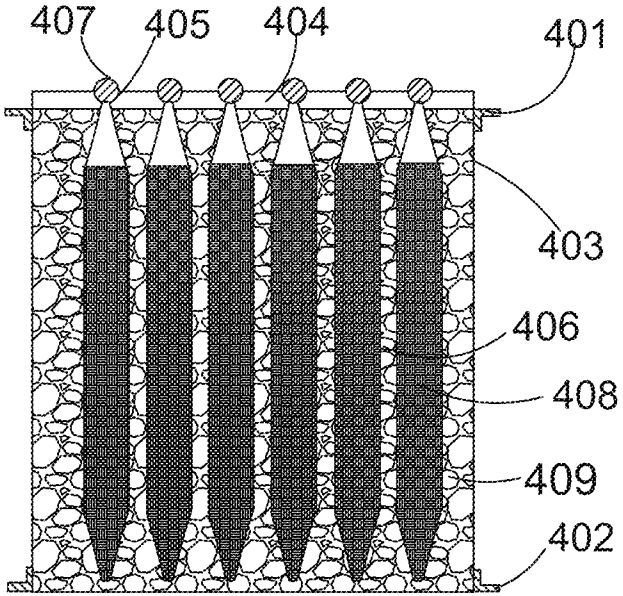
FIG. 4*c* is the vertical cross-section of the metal carcass shaped as the rectangular parallelepiped with two auxiliary angles installed on two opposite upper edges of the metal carcass; the vertical shelves of these angles are provided with sets of recesses, and there are sealed flexible packs containing PCM; the upper edges of these sealed flexible packs are joined with crossbars with outside sections, which are protruded outwards regarding the contours of the sealed flexible packs and these outside sections are arranged in the recesses of the angles.

FIG. 4*c* is the vertical cross-section of the metal carcass shaped as the rectangular parallelepiped with two auxiliary angles installed on two opposite upper edges of the metal carcass; the vertical shelves of these angles are provided with sets of recesses, and there are sealed flexible packs containing PCM; the upper edges of these sealed flexible packs are joined with crossbars with outside sections, which are protruded outwards regarding the contours of the sealed flexible packs and these outside sections are arranged in the recesses of the angles.

This drawing shows the upper angles 401, the lower angles 402; the vertical angles 403; two auxiliary angles 404, which are installed on two opposite upper edges of the metal carcass and provided with two sets of recesses 405 at their upper shelves; sealed flexible packs 406 are joined with crossbars 407 and contain PCM 408; the outside sections of crossbars 407 are positioned in recesses 405; pebble filling 409, which restricts buckling phenomena of the sealed flexible packs 406 with melted PCM 408 under hydraulic pressure.

Figure 5A:
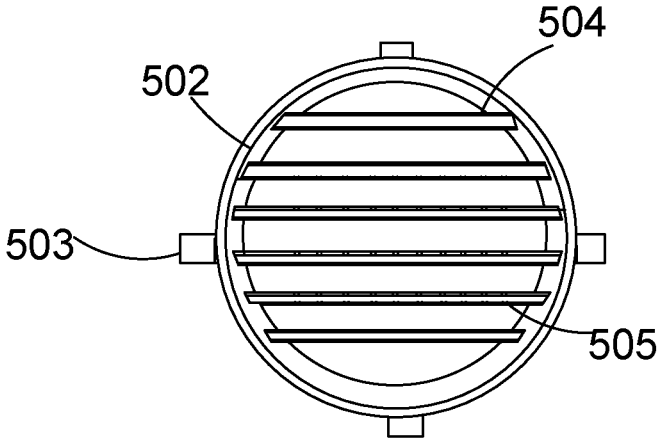
FIG. 5*a* is a view from above of a metal carcass shaped as a cylinder with some horizontal auxiliary U-profiles installed on upper edge of the metal carcass; the vertical shelves of these horizontal U-profiles are provided with sets of recesses.

FIG. 5*a* is a view from above of a metal carcass shaped as a cylinder with some auxiliary horizontal U-profiles installed on upper edge of the metal carcass; the vertical shelves of these horizontal angles are provided with sets of recesses.

Figure 5B:
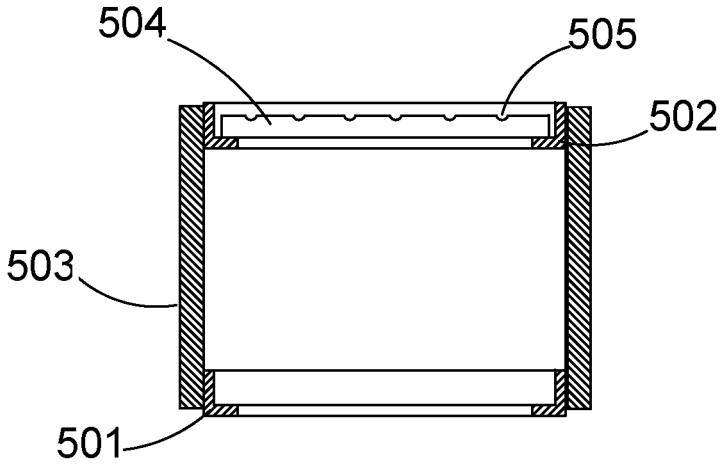
FIG. 5*b* is a vertical cross-section of the metal carcass shaped as the cylinder with some auxiliary horizontal U-profiles installed on the upper edge of the metal carcass; the vertical shelves of these horizontal U-profiles are provided with sets of recesses.

FIG. 5*b* is a vertical cross-section of the metal carcass shaped as the cylinder with some horizontal auxiliary U-profiles installed on the upper edge of the metal carcass; the vertical shelves of these horizontal U-profiles are provided with sets of recesses.

They show: a lower metal hoop 501; an upper metal hoop 502; vertical struts 503, which join the lower and upper metal hoops 501 and 502; auxiliary horizontal U-profiles 504 installed on the upper metal hoop 502; the vertical shelves of the auxiliary horizontal U-profiles are provided with sets of recesses 505.

Figure 5C:
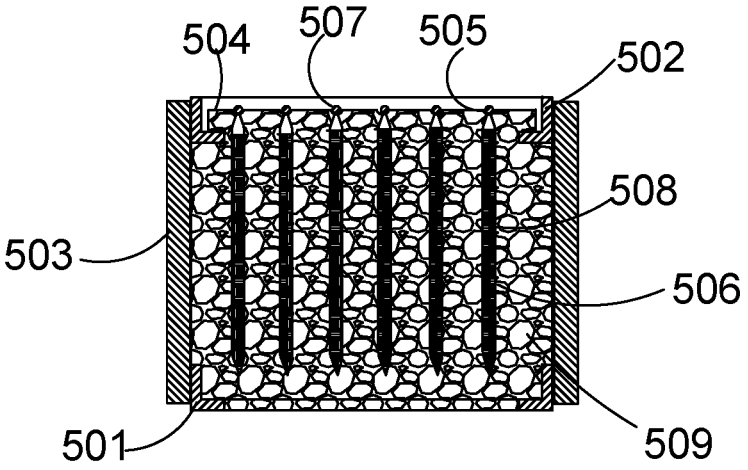
FIG. 5*c* is the vertical cross-section of the metal carcass shaped as the cylinder with some auxiliary horizontal U-profiles installed on the upper edge of the metal carcass; the vertical shelves of these horizontal U-profiles are provided with sets of recesses, and there are sealed flexible packs containing PCM; the upper edges of these sealed flexible packs are joined with crossbars with outside sections, which are protruded out the contours of the sealed flexible packs and these outside sections are arranged in the recesses of the U-profiles.

FIG. 5*c* is the vertical cross-section of a metal carcass shaped as the rectangular parallelepiped with some auxiliary horizontal U-profiles installed on the upper edge of the metal carcass; the vertical shelves of these horizontal U-profiles are provided with sets of recesses, and there are sealed flexible packs containing PCM; the upper edges of these sealed flexible packs are joined with crossbars with outside sections, which are protruded outwards regarding the contours of the sealed flexible packs and these outside sections are arranged in the recesses of U-profiles.

It shows: the lower metal hoop 501; the upper metal hoop 502; the vertical struts 503, which join the lower and upper metal hoops 501 and 502; the auxiliary horizontal U-profiles 504 installed on the upper metal hoop 502; the vertical shelves of the auxiliary horizontal U-profiles 504 are provided with sets of recesses 505; sealed flexible packs 506 are joined with crossbars 507 and contain PCM 508; the outside sections of crossbars 507 are positioned in recesses 505; pebble filling 509, which restricts buckling phenomena of the sealed flexible packs 506 with melted PCM 508 under hydraulic pressure.

Figure 6A:
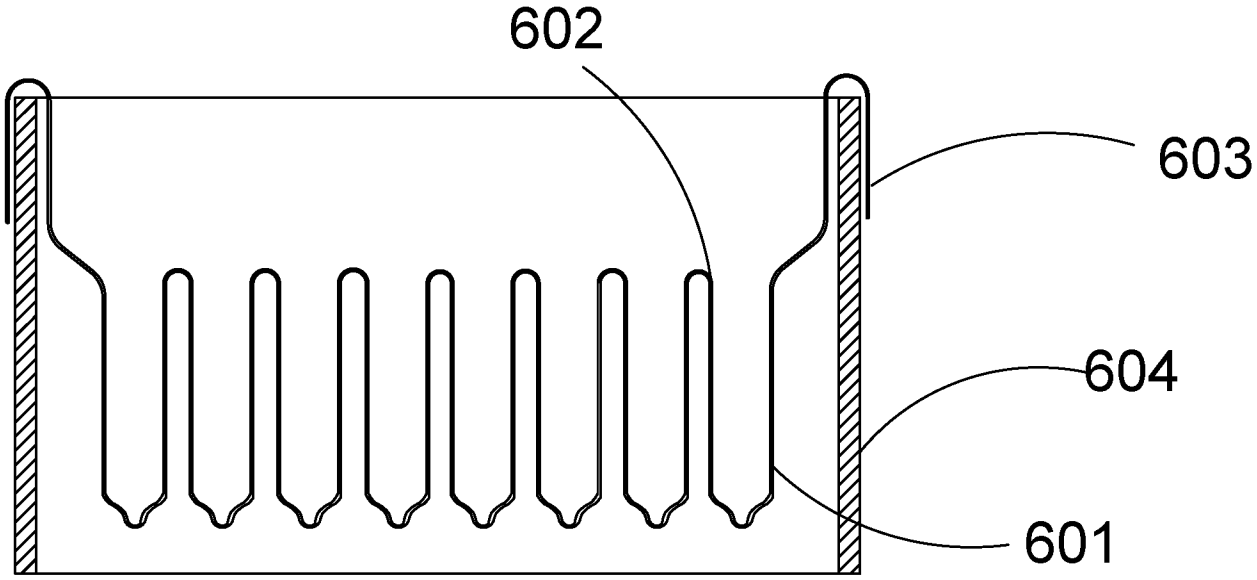
FIG. 6*a* and FIG. 6*b* show a vertical cross-section and a view from above of a rigid structure shaped as a rectangular parallelepiped, which is provided with two opposite metal supporting strips situated near the internal lateral sides of this rigid structure, a supporting metal strip, which is formed in a periodic way, wherein each period comprises: supporting sub-sections serving as supporting elements for extreme sections of the lower part of the oblate sealed flexible pack filled partially with PCM; intermediate sub-sections, which determine gaps between two neighboring oblate sealed flexible packs; two extreme sub-sections being engaged with two other opposite lateral sides of the rigid structure.
Figure 6B:
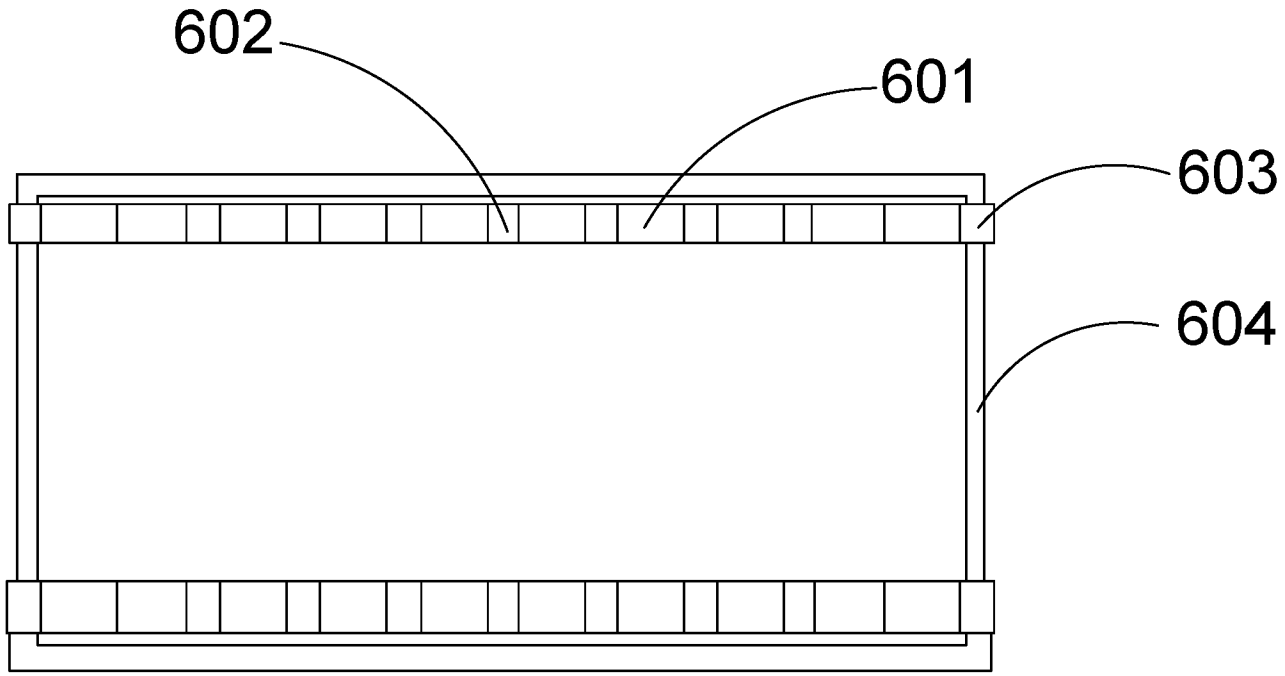

FIG. 6*a* and FIG. 6*b* show a vertical cross-section and a view from above of a rigid structure shaped as a rectangular parallelepiped, which is provided with two opposite metal supporting strips situated near the internal lateral sides of this rigid structure, a supporting metal strip, which is formed in a periodic way, wherein each period comprises: supporting sub-sections serving as supporting elements for extreme sections of the lower part of the oblate sealed flexible pack filled partially with PCM; intermediate sub-sections, which determine gaps between two neighboring oblate sealed flexible packs; two extreme sub-sections being engaged with two other opposite lateral sides of the rigid structure.

They comprise: the supporting sub-sections 601 of the strip, the intermediate sub-sections 602 of the strip, the extreme sub-sections 603 of the strip.

Figure 6C:
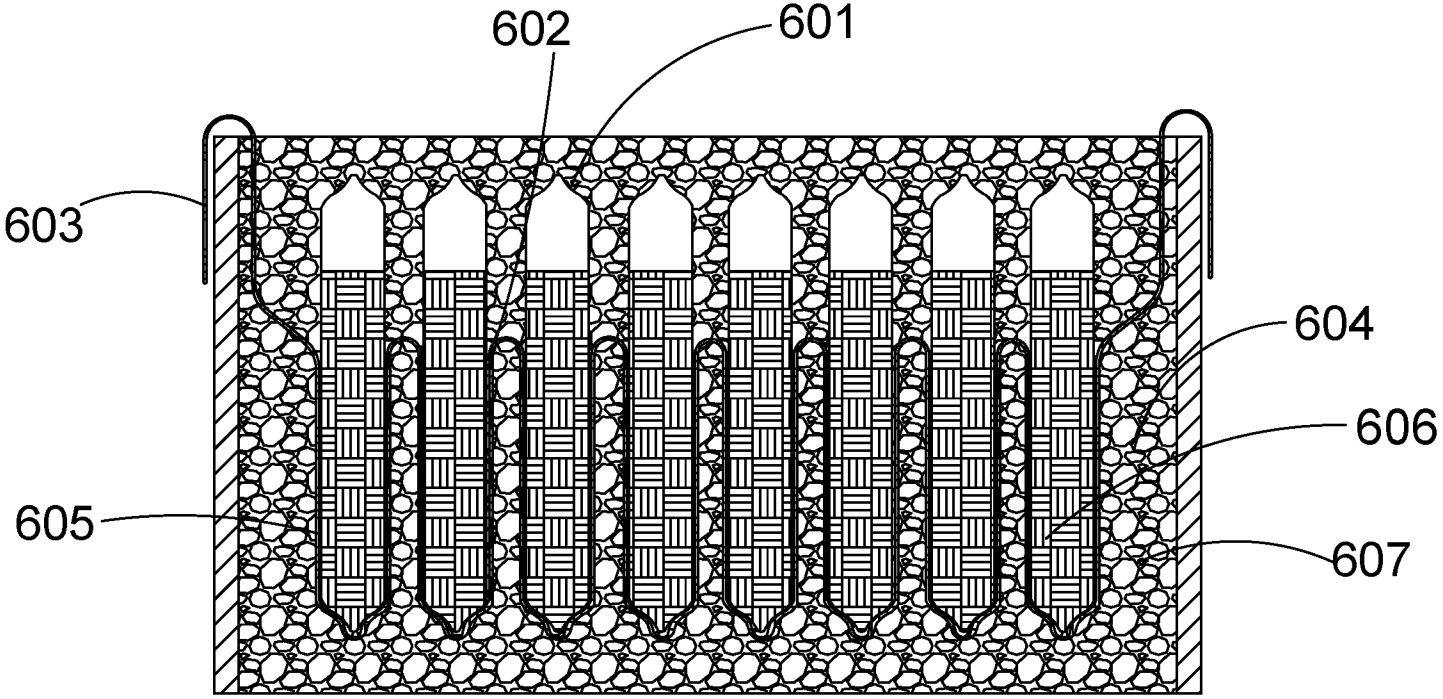
FIG. 6*c* shows a vertical cross-section of a rigid structure shaped as a rectangular parallelepiped, which is provided with two opposite metal supporting strips situated near the internal lateral sides of this rigid structure.

FIG. 6*c* shows a vertical cross-section of a rigid structure shaped as a rectangular parallelepiped, which is provided with two opposite metal supporting strips situated near the internal lateral sides of this rigid structure. The extreme sections of the sealed flexible packs are supported by the supporting-sub-sections of the metal supporting trips. The free space in the rigid structure is filled with pebble.

It comprises: the supporting sub-sections 601, the intermediate sub-sections 602, the extreme sub-sections 603, vertical walls 604 of the rigid structure shaped as a rectangular parallelepiped, sealed flexible packs 605 filled partially with PCM 606, pebble filling 607.

Figure 7:
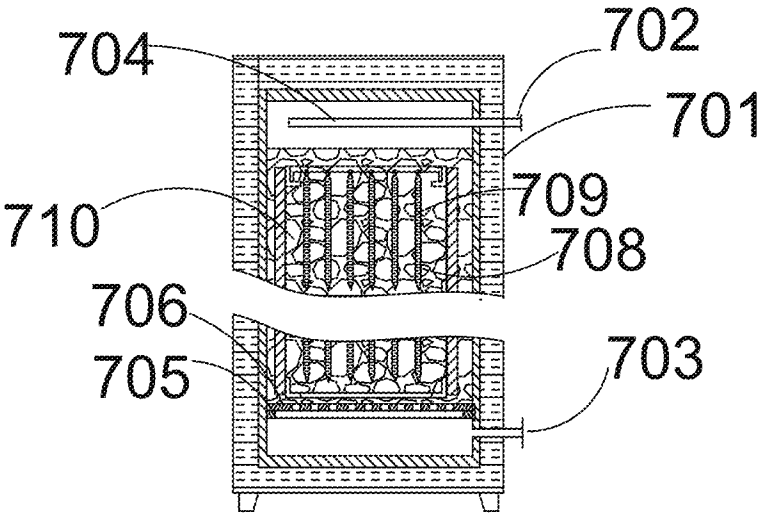
FIG. 7 shows a vertical cross-section of a heat or cold storage multilayer reservoir with a multilayer arrangement of heat or cold storage cylindrical modules (as they are presented in FIG. 5*a, b, c*), which are provided with sealed flexible packs containing PCM.

FIG. 7 shows a vertical cross-section of a heat or cold storage multilayer reservoir with an arrangement of multilayer cylindrical modules (as they are presented in FIG. 5*c*), which are provided with sealed flexible packs containing PCM.

It comprises: a thermo-insulated housing 701 with inlet and outlet connections 702 and 703; distributor 704; supporting rings 705; perforated supporting plates 606; the cylindrical modules 707 and sealed flexible packs 708 filled with PCM 709; pebble filling 710.

REFERENCES CITED

| U.S. Patent Documents | | |
|---|---|---|
| 4,086,958 | May 1978 | Linder et al. |
| 4,088,183 | May 1978 | Anzai et al. |
| 4,111,260 | September 1978 | Bricard et al. |
| 4,234,782 | November 1980 | Barabas et al. |
| 4,241,782 | December 1980 | Schoenfelder |
| 4,270,523 | June 1981 | van Heel |

-continued

| | | |
|---|---|---|
| 4,286,574 | September 1981 | Vrolyk et al. |
| 4,371,029 | February 1983 | Lindner et al. |
| 4,408,659 | October 1983 | Hermanns et al. |
| 4,524,756 | June 1985 | Laverman |
| 4,807,696 | February 1989 | Colvin et al. |
| 4,993,481 | February 1991 | Kamimoto et al. |
| 6,037,032 | March 2000 | Klett et al. |
| 6,116,330 | September 2000 | Salyer |
| 7,222,659 | May 2007 | Levin |
| 2002/0000306 | January 2002 | Bradley |
| Foreign Patent Documents | | |
| 57-204796 | December 1982 | JP |

OTHER REFERENCES

Peter R. Payne, Which material uses the least energy?, Chemtech, September 1980, pp. 550-557. cited by other.

The invention claimed is:

1. A heat or cold storage multistage reservoir comprising: a thermo-insulated housing, which is provided with two opposite inlet and outlet connections for supply and withdrawal of heat transfer fluid (HTF) in/out an internal space of said thermo-insulated housing; said inlet/outlet connections determine one direction of HTF flow in the internal space of said thermo-insulated housing; said internal space of said thermo-insulated housing is provided with multilayers of heat or cold storage modules, wherein each said heat or cold module comprises a ceramic rectangular parallelepiped wherein each said rectangular parallelepiped has an internal space and consists essentially of four vertical sections, one lower section perforated plate, and an open top section; each said rectangular parallelepiped is fabricated from ceramics; said heat or cold storage modules are installed in said internal space of said thermo-insulated housing in a multilayer arrangement; The internal space of each said rectangular parallelepiped is provided with a set or sets of sealed flexible packs, wherein each said sealed flexible pack having an oblate shape and filled partially with phase change material (PCM) that changes its state from solid to liquid and vice versa at its phase transition temperature; said sealed flexible packs are arranged within each rectangular parallelepiped in parallel with gaps between them, said gaps being permeable to the HTF flow and filled with pebble or coarse sand; and wherein gaps between the sealed flexible packs and the internal walls of each rectangular parallelepiped, gaps between adjacent storage modules, and gaps between storage modules and the internal walls of the thermo-insulated housing are also filled with pebble or coarse sand.

2. The heat or cold storage multistage reservoir as claimed in claim 1, wherein the sealed flexible packs are filled up at least partially with different PCM with gradual change of melting points from one stage of the heat or cold storage modules to another.

* * * * *